US009863415B2

(12) United States Patent
St. Denis

(10) Patent No.: US 9,863,415 B2
(45) Date of Patent: Jan. 9, 2018

(54) PUMPING ASSEMBLY

(71) Applicant: 1238585 Alberta Ltd., Lloydminster (CA)

(72) Inventor: Perry L. St. Denis, Lloydminster (CA)

(73) Assignee: 1238585 ALBERTA LTD., Lloydminster (CA)

( * ) Notice: Subject to any disclaimer, the term of this patent is extended or adjusted under 35 U.S.C. 154(b) by 0 days.

(21) Appl. No.: 14/492,958

(22) Filed: Sep. 22, 2014

(65) Prior Publication Data

US 2015/0139829 A1 May 21, 2015

Related U.S. Application Data

(63) Continuation of application No. 14/016,188, filed on Sep. 2, 2013, now Pat. No. 8,875,781, which is a (Continued)

(30) Foreign Application Priority Data

Dec. 18, 2003 (CA) ..... 2451918

(51) Int. Cl.
*F04B 47/02* (2006.01)
*F04B 47/04* (2006.01)
(Continued)

(52) U.S. Cl.
CPC ..... *F04B 47/04* (2013.01); *E21B 43/121* (2013.01); *E21B 43/126* (2013.01); *F04B 9/105* (2013.01);
(Continued)

(58) Field of Classification Search
CPC ..... F04B 47/00; F04B 47/02; F04B 47/04; F04B 9/105; F04B 9/1053; E21B 43/12;
(Continued)

(56) References Cited

U.S. PATENT DOCUMENTS 1,793,793 A 2/1931 Granger
2,490,323 A * 12/1949 Pounds ..... F04F 1/06 60/372

(Continued)

FOREIGN PATENT DOCUMENTS

CA 2403439 1/2003
RU 2133875 7/1999

OTHER PUBLICATIONS

Leslie, Office action dated May 5, 2011, in U.S. Appl. No. 11/997,140, filed Aug. 6, 2008.

*Primary Examiner* — Peter J Bertheaud
(74) *Attorney, Agent, or Firm* — Eubanks PLLC

(57) ABSTRACT

A pumping assembly includes a hydraulic pump having a hydraulic ram tied to a reciprocating annular piston having a central bore. When the annular piston moves in an upward direction, the hydraulic ram moves toward an extended position extending from the housing. When the annular piston moves in a downward direction, the hydraulic ram moves toward a retracted position retracted within the housing. A polish rod extends up through the central bore of the annular piston and is held in position by a polish rod clamp positioned on top of the hydraulic ram. The polish rod moves with the hydraulic ram. Other pumping systems, devices, and methods are also disclosed.

9 Claims, 3 Drawing Sheets

Related U.S. Application Data continuation of application No. 11/015,292, filed on Dec. 17, 2004, now Pat. No. 8,523,543.

(51) Int. Cl.
*F04B 9/105* (2006.01)
*E21B 43/12* (2006.01)

(52) U.S. Cl.
CPC ..... *F04B 9/1053* (2013.01); *F04B 47/02* (2013.01); *Y10S 417/904* (2013.01)

(58) Field of Classification Search
CPC ..... E21B 43/121; E21B 43/126; E21B 34/10; Y10S 417/904
USPC .... 417/375, 398, 415, 555.1, 904; 166/68.5, 166/72, 372; 73/1.79
See application file for complete search history.

(56) References Cited

U.S. PATENT DOCUMENTS

| | | | | | |
|---|---|---|---|---|---|
| 2,540,347 | A | | 2/1951 | Pounds | |
| 2,560,441 | A | | 7/1951 | Holl | |
| 2,564,285 | A | * | 8/1951 | Smith | F04B 47/04 60/372 |
| 2,612,142 | A | | 9/1952 | Smith | |
| 2,668,517 | A | * | 2/1954 | Craft | F04B 47/04 166/79.1 |
| 2,699,154 | A | * | 1/1955 | Smith | 417/904 |
| 2,838,910 | A | * | 6/1958 | Bacchi | F04B 47/04 91/216 B |
| 3,212,406 | A | | 10/1965 | McDuffie | |
| 4,187,765 | A | | 2/1980 | Mattoon | |
| 4,268,228 | A | | 5/1981 | McKee | |
| 4,305,461 | A | | 12/1981 | Meyer | |
| 4,380,150 | A | | 4/1983 | Carlson | |
| 4,414,808 | A | * | 11/1983 | Benson | F04B 47/04 417/402 |
| 4,646,517 | A | | 3/1987 | Wright | |
| 4,707,993 | A | | 11/1987 | Kime | |
| 5,031,402 | A | * | 7/1991 | Klaeger | F04B 47/04 417/401 |
| 5,536,150 | A | | 7/1996 | Tucker | |
| 5,832,727 | A | | 11/1998 | Stanley | |
| 5,996,688 | A | | 12/1999 | Schultz et al. | |
| 8,523,543 | B2 | | 9/2013 | St Denis | |
| 8,794,932 | B2 | * | 8/2014 | Rogers | F04B 47/08 417/398 |
| 8,875,781 | B2 | | 11/2014 | St Denis | |

* cited by examiner

PUMPING ASSEMBLY

TECHNICAL FIELD

The present invention relates to a pumping assembly for pumping liquids from a well.

BACKGROUND

Canadian Patent 2,403,439 describes a method of pumping liquids from a well using a tubing string. Problems have been experienced in the field with installations using this method. With the method, pumped fluids passed through the tubing string and out through the top of the pump. A hose attachment was required to direct the pumped fluids to appropriate storage. Repeated movement of the tubing string served to fatigue the hose, requiring frequent servicing. Under some pumping conditions, this pumping action would dislodge the tubing anchor.

SUMMARY

The present invention relates to a pumping assembly which overcomes the disadvantages of the above described method.

According to one embodiment of the present invention there is provided a pumping assembly, which includes a well head with a radial flow channel for pumped fluids. A spacer stand is secured to the well head. A hydraulic pump is provided with a housing secured to the spacer stand. The hydraulic pump has a hydraulic ram tied to a reciprocating annular piston having a central bore. When the annular piston moves in an upward direction the hydraulic ram moves toward an extended position extending from the housing. When the annular piston moves in a downward direction, the hydraulic ram moves toward a retracted position retracted within the housing. A polish rod extends up through the central bore of the annular piston and is held in position by a polish rod clamp positioned on top of the hydraulic ram. The polish rod moves with the hydraulic ram. A stuffing box is positioned within the spacer stand and engages the polish rod to prevent pumped fluids from bypassing the radial flow channel by passing along the polish rod and through the central bore of the annular piston.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF SPECIFIC EMBODIMENTS

Figure 1:
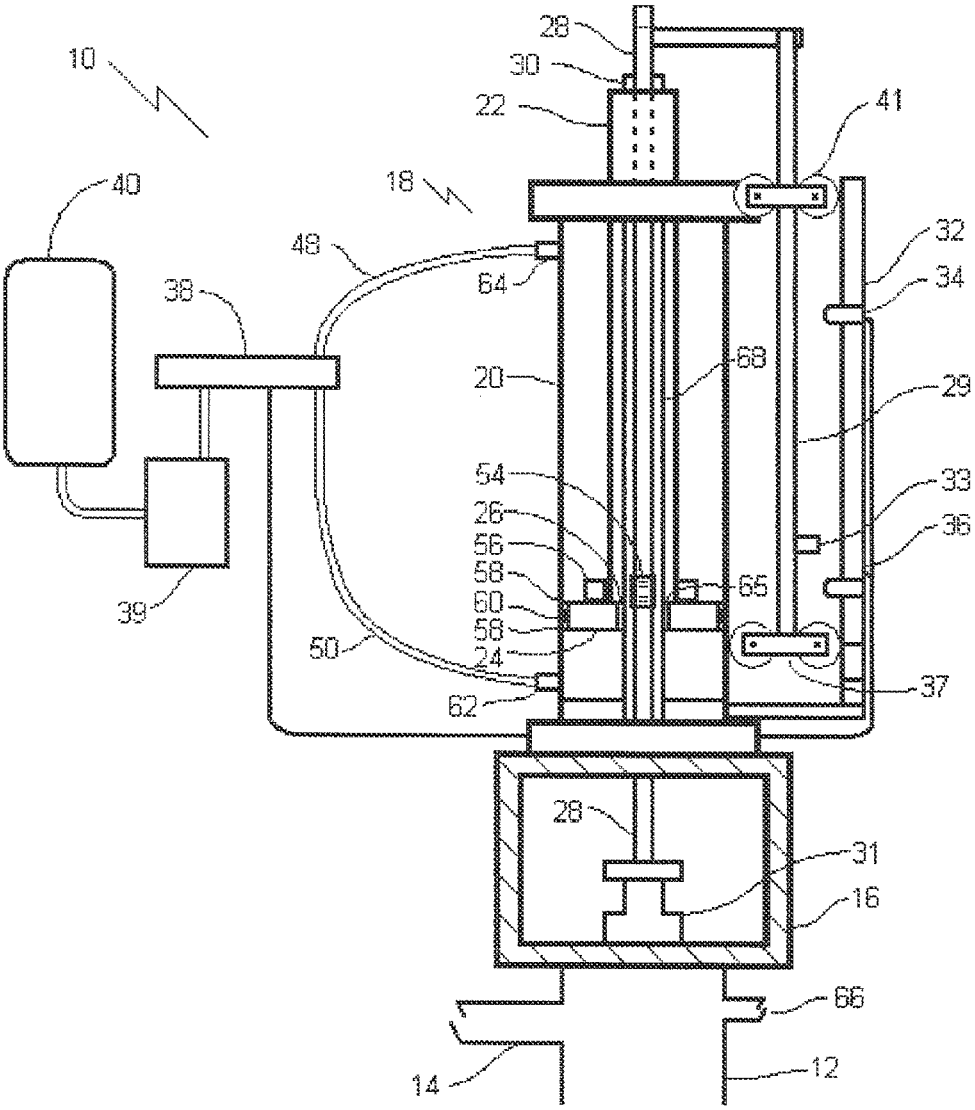
FIG. 1 is a side elevation view, in section, of a pumping assembly constructed in accordance with the teachings of the present invention, with the hydraulic ram in an extended position.

The preferred embodiment, a pumping assembly generally identified by reference numeral 10, will now be described with reference to FIGS. 1 and 2.

Structure:

Referring to FIG. 1, there is shown a pumping assembly 10 comprised of a well head 12 with a radial flow channel 14 for pumped fluids, a spacer stand 16 secured to the well head 12, and a hydraulic pump 18 with a housing 20 secured to the spacer stand 16. The hydraulic pump 18 has a hydraulic ram 22 tied to a reciprocating annular piston 24 that has a central bore 26, such that when the annular piston 24 moves in an upward direction, the hydraulic ram 22 moves toward an extended position extending from the housing 20, and when the annular piston 24 moves in a downward direction, the hydraulic ram 22 moves toward a retracted position retracted within the housing 20. There is also a polish rod 28 extending up through the central bore 26 of the annular piston 24 and held in position by a polish rod clamp 30 positioned on top of the hydraulic ram 22, such that the polish rod 28 moves with the hydraulic ram 22. Within the housing 20, the polish rod 28 is also surrounded by a secondary tube 68 as well as the hydraulic ram 22. At the bottom of the hydraulic ram 22 are located seals 65. On the bottom of the housing 20 and around the hydraulic ram 22 are located bearings 60, bearing seal 58, and a stop block 56. Stop block 56 moves with ram 22, and ensures that ram 22 does not extend too far up or down in the event of an equipment malfunction. Rod coupling 54 is used to attach two rods together to simplify installation. There is also a stuffing box 31 positioned within the spacer stand 16 and engaging the polish rod 28 to prevent pumped fluids from bypassing the radial flow channel 14 by passing along the polish rod 28 and through the central bore 26 of the annular piston 24.

Figure 3:
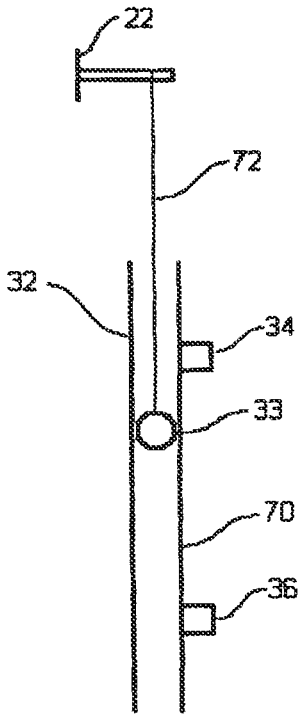
FIG. 3 is an alternate view of an external guide.

Another feature of the invention is an external guide 32 that is provided on the hydraulic pump 18. The external guide 32 is stationary and has an upper proximity switch 34 and a lower proximity switch 36 tied to control valves 38 and a source of hydraulic fluid 40. A moving guide 29 is attached to hydraulic ram 22 or another part that moves with hydraulic ram 22 such as polish rod 28. Moving guide 29 has a piece of metal 33 attached to it such that, as it approaches the proximity switch 36, the switch 36 is triggered, causing the ram 22 to extend. As piece of metal 33 approaches proximity switch 34, the switch 34 is triggered and the ram 22 begins to retract. The moving guide 29 is guided by wheels 37 which move with the moving guide 29, and wheels 41 which are attached to the stationary guide 32 and the housing 20. Referring to FIG. 3, the external guide 32 comprises a tube 70 of non-conducting piping such as PVC piping. Proximity switches 34 and 36 are attached directly to the outside of piping 70. Piece of metal 33 is attached to wire 72 which moves up and down with ram 22. The operation of the switches proceeds as before.

Figure 2:
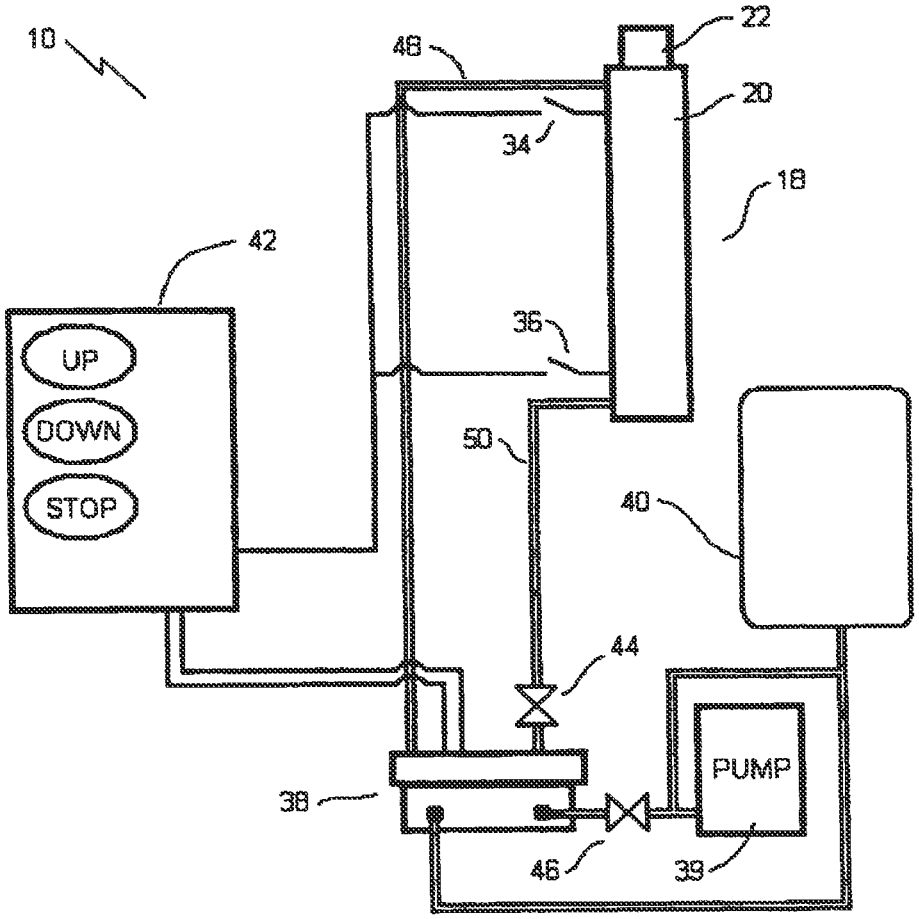
FIG. 2 is a block diagram of a pumping assembly constructed in accordance with the teachings of the present invention, with the hydraulic ram in a retracted position.

Referring to FIG. 2, the proximity switches 34 and 36 may also be tied to a control panel 42 that also includes override buttons such as up, down, or stop for manual control of the hydraulic pump. When the upper proximity switch 34 is triggered, hydraulic fluid is pumped from the source of hydraulic fluid 40 by pump 39 via the control valves 38 through line 48 into the hydraulic pump 18 from above the annular piston 24 to urge the annular piston 24 in the downward direction. When the lower proximity switch 36 is triggered, hydraulic fluid is pumped from the source of hydraulic fluid 40 by pump 39 via the control valves 38 through line 50 into the hydraulic pump 18 from below the annular piston 24 to urge the annular piston 24 in the upward direction. Referring to FIG. 1, the hydraulic fluid is pumped into the hydraulic pump through hydraulic input 62 on the bottom and hydraulic input 64 on the top.

Operation:

Referring to FIG. 1, liquids are pumped from a well through well head 12 and through a radial flow channel 14 by using a pumping assembly 10. There may also be a sample test cock 66 on the well head 12 for obtaining samples. The liquid is pumped from the well using a hydraulic pump 18. Hydraulic pump 18 includes a piston 24 with a hydraulic ram 22 and a polish rod 28 inside the hydraulic ram 22. The liquid is pumped as the hydraulic ram 22 is pushed up and down. The up and down movement is controlled by hydraulic fluid pumped through control valves 38 into either the hydraulic input 64 on top of the hydraulic pump 18 or into the hydraulic input 62 on the bottom of the hydraulic pump 18. As the hydraulic ram moves up and down, proximity switches 34 and 36 on external guide 32 are triggered by piece of metal 33, sending signals to the control valves 38 to change the direction. When the upper proximity switch 24 is triggered, hydraulic fluid is pumped from the source of hydraulic fluid 40 by pump 39 via the control valves 38 through line 48 into the hydraulic pump 18 from above the annular piston 24 to urge the annular piston 24 in the downward direction. When the lower proximity switch 36 is triggered, hydraulic fluid is pumped from the source of hydraulic fluid 40 by pump 39 via the control valves 38 through line 50 into the hydraulic pump 18 from below the annular piston 24 to urge the annular piston 24 in the upward direction.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The invention claimed is:

1. A pumping assembly comprising:

a well head;

a hydraulic pump including: an external housing coupled to the well head; a secondary tube inside the external housing and extending from the bottom toward the top of the external housing; a hydraulic ram tied to an annular piston mounted on the secondary tube inside the external housing to allow the annular piston to move along the secondary tube during operation of the hydraulic pump; a rod disposed in the secondary tube and connected to the hydraulic ram; and a hydraulic chamber that is divided by the annular piston into a first subchamber positioned below the annular piston within the external housing and a second subchamber positioned above the annular piston within the external housing, wherein the first subchamber is bound at one end by the annular piston and that one end at the annular piston extends continuously along the annular piston from the secondary tube to the external housing, and the external housing surrounds an outermost periphery of the piston; and an additional pump connected to the hydraulic pump so as to enable automatically driving reciprocal motion of the annular piston within the external housing by alternatingly pumping hydraulic fluid from the additional pump into the first subchamber to move the annular piston in the upward direction to cause the hydraulic ram to lift the rod and move toward an extended position from the external housing and pumping hydraulic fluid from the additional pump into the second subchamber to move the annular piston in the downward direction to cause the hydraulic ram to lower the rod and move toward a retracted position within the external housing.

2. The pumping assembly of claim 1, comprising a stuffing box positioned between the external housing and the well head.

3. The pumping assembly of claim 2, comprising a rod coupling that joins the rod disposed in the secondary tube to another rod extending through the stuffing box.

4. The pumping assembly of claim 1, wherein the external housing is coupled to the well head via a spacer stand.

5. A pumping assembly comprising:

a hydraulic pump installed at a well head, the hydraulic pump including a housing and a hydraulic ram tied to a piston that is disposed within the housing, wherein the hydraulic ram extends out of the top of the housing, the piston divides a hydraulic chamber within the housing into a first subchamber below the piston and a second subchamber above the piston, and the housing surrounds an outermost periphery of the piston;

an additional pump connected to the hydraulic pump so as to enable automatically driving reciprocal motion of the piston within the housing by alternatingly pumping hydraulic fluid from the additional pump into the first subchamber to move the piston upward to cause the hydraulic ram to move upward and extend from the housing and pumping hydraulic fluid from the additional pump into the second subchamber to move the piston downward to cause the hydraulic ram to move downward and retract into the housing;

a piece of metal positioned outside of the housing of the hydraulic pump and coupled to the hydraulic ram to move with the hydraulic ram during operation of the hydraulic pump; and a guide tube positioned along the outside of the housing with first and second proximity switches coupled to an exterior of the guide tube, wherein the guide tube facilitates movement of the piece of metal through the guide tube between the first and second proximity switches during operation of the hydraulic pump so as to trigger pumping of hydraulic fluid from the additional pump into the first subchamber upon detection of the piece of metal by the first proximity switch and so as to trigger pumping of hydraulic fluid from the additional pump into the second subchamber upon detection of the piece of metal by the second proximity switch.

6. The pumping assembly of claim 5, wherein the first and second proximity switches are connected to control valves to enable triggering of the first and second proximity switches by the piece of metal to control operation of the hydraulic pump.

7. The pumping assembly of claim 5, wherein the piece of metal is coupled to the hydraulic ram via a rod connected to the hydraulic ram.

8. The pumping assembly of claim 5, wherein the piece of metal includes a bob suspended within the guide tube from a wire.

9. A pumping assembly comprising:

a hydraulic pump installed at a well head, the hydraulic pump including a housing and a hydraulic ram tied to a piston that is disposed within the housing, wherein the hydraulic ram extends out of the top of the housing, the piston divides a hydraulic chamber within the housing into a first subchamber below the piston and a second subchamber above the piston, and the housing surrounds an outermost periphery of the piston;

an additional pump connected to the hydraulic pump so as to enable automatically driving reciprocal motion of the piston within the housing by alternatingly pumping hydraulic fluid from the additional pump into the first subchamber to move the piston upward to cause the hydraulic ram to move upward and extend from the housing and pumping hydraulic fluid from the additional pump into the second subchamber to move the piston downward to cause the hydraulic ram to move downward and retract into the housing;

a piece of metal positioned outside of the housing of the hydraulic pump and coupled to the hydraulic ram to move with the hydraulic ram during operation of the hydraulic pump; and an external guide positioned along the outside of the housing with first and second proximity switches coupled to the external guide, wherein the external guide facilitates movement of the piece of metal between the first and second proximity switches during operation of the hydraulic pump so as to trigger pumping of hydraulic fluid from the additional pump into the first subchamber upon detection of the piece of metal by the first proximity switch and so as to trigger pumping of hydraulic fluid from the additional pump into the second subchamber upon detection of the piece of metal by the second proximity switch, and wherein the external guide includes a non-conducting pipe and the piece of metal is positioned within the non-conducting pipe.

* * * * *